US007036955B2

(12) United States Patent
Kazi et al.

(10) Patent No.: US 7,036,955 B2
(45) Date of Patent: May 2, 2006

(54) STRIP LIGHTING HOUSING AND FIXTURE ASSEMBLY

(75) Inventors: Ashfaq M. Kazi, Chino Hills, CA (US); Syed M. Afzal Hussain, Diamond Bar, CA (US)

(73) Assignee: American Power Products, Inc., Corona, CA (US)

( * ) Notice: Subject to any disclaimer, the term of this patent is extended or adjusted under 35 U.S.C. 154(b) by 133 days.

(21) Appl. No.: 10/644,816

(22) Filed: Aug. 21, 2003

(65) Prior Publication Data

US 2005/0041419 A1 Feb. 24, 2005

(51) Int. Cl.
*F21S 4/00* (2006.01)

(52) U.S. Cl. ..... 362/219; 362/225; 362/260; 362/418; 362/457

(58) Field of Classification Search ..... 362/217–225, 362/260, 418, 457
See application file for complete search history.

(56) References Cited

U.S. PATENT DOCUMENTS

| | | | | | |
|---|---|---|---|---|---|
| 2,291,491 | A | * | 7/1942 | Naysmith | 362/221 |
| 2,383,007 | A | * | 8/1945 | Maurette | 362/457 |
| 2,434,781 | A | * | 1/1948 | Kurtzon | 362/219 |
| 2,465,141 | A | | 3/1949 | Wakefield | |
| 2,503,876 | A | * | 4/1950 | Krauss | 362/217 |
| 2,588,144 | A | | 3/1952 | Mided et al. | |
| 2,662,163 | A | | 12/1953 | Mollner | |
| 3,349,237 | A | * | 10/1967 | Jackson | 362/219 |
| 3,673,402 | A | | 6/1972 | Weiss | |
| 4,533,981 | A | | 8/1985 | Radek | |
| 4,992,915 | A | | 2/1991 | Meister | |
| 5,226,724 | A | * | 7/1993 | Kanarek | 362/260 |
| 5,624,178 | A | | 4/1997 | Lee, Jr. | |
| 5,658,066 | A | | 8/1997 | Hirsch | |
| 6,305,816 | B1 | | 10/2001 | Corcorran et al. | |
| 6,431,726 | B1 | | 8/2002 | Barton | |
| 6,439,742 | B1 | | 8/2002 | Lavergne | |
| 6,511,213 | B1 | | 1/2003 | Maley, Sr. | |

* cited by examiner

*Primary Examiner*—Stephen Husar
*Assistant Examiner*—Jason Han
(74) *Attorney, Agent, or Firm*—Rosenberg, Klein & Lee

(57) ABSTRACT

A strip lighting housing and fixture assembly (10) is provided. The strip lighting housing and fixture assembly (10) includes first and second housing sections (12 and 14) which releasably engage one another. Sections (12 and 14) are releasably locked to one another by a locking plate (30) and further by a removable connecting member (42). Additionally, a pair of cover members (38, 40) are provided, with the cover members (38, 40) being releasably joined to the respective first and second housing sections (12 and 14). The lighting housing and fixture assembly (10) is collapsible and may be selectively disassembled.

16 Claims, 6 Drawing Sheets

STRIP LIGHTING HOUSING AND FIXTURE ASSEMBLY

BACKGROUND OF THE INVENTION

1. Field of the Invention

The subject invention relates to a strip lighting housing and fixture assembly for mounting strip lighting elements and associated electronics to a supporting surface. In particular, the present invention directs itself to first and second housing sections which may be manufactured and shipped separate from one another and releasably secured to one another to form the full strip lighting housing assembly. More particularly, this invention directs itself to a strip lighting housing and fixture assembly including a releasable connecting member for releasably locking the first and second housing sections to one another.

Further, the strip lighting housing and fixture assembly includes first and second bracket members which are respectively received within the first and second housing sections for releasable attachment to first and second cover members. The first and second housing sections, connecting member, first and second bracket members, and the first and second cover members are all releasably coupled to one another in order to form a strip lighting housing and fixture assembly which is collapsible, portable, and may be easily assembled and manufactured.

2. Prior Art

Strip lighting housings are well-known in the art. In general, such prior art strip lighting housings include a main housing section along with fixtures for securing the main housing section to a support surface. In many instances, the problems of such prior art strip lighting housings are that the housing assemblies are unwieldy, excessively bulky and are difficult to both manufacture and ship. It is a purpose of the subject invention to provide a combination of elements making up a strip lighting housing and fixture assembly including first and second housing sections which may be releasably secured to one another in order to form a main strip lighting housing which may be manufactured, shipped, and assembled with ease.

One such prior art lighting fixture is shown in U.S. Pat. No. 3,673,402. This reference is directed to an extendable lighting fixture. The extendable lighting fixture includes a nested pair of housing sections, with one housing section being smaller than the other, with the smaller housing section telescoping from the larger. Each housing section, however, due to the difference in sizes, must be manufactured separate from one another and further, the two housing sections require a complex telescoping fixture system to secure one to the other.

Another such prior art lighting fixture is shown in U.S. Pat. No. 2,588,144. This reference is directed to a jointed fluorescent lamp fixture. This system includes a hinged cover assembly for the lighting fixture, however, the system is not formed from separate releasably locking housing sections.

U.S. Pat. No. 2,465,141 is directed to a lighting fixture for tubular lamps. This system provides for modular, interlocking lighting housings. However, each housing is designed to be of standard strip-lighting length and thus, suffers from the common problems involved in the manufacture and assembly of typical bulky lighting housings.

U.S. Pat. No. 6,431,726 is directed to a folding and adjusting side-sliding fluorescent lamp fixture. This reference includes a pair of lighting housings pivotally secured to one another and fixed side-to-side. Each lighting housing, however, is of standard size and with the side-to-side arrangement, the two housings do not form one continuous strip lighting housing.

Another prior art strip lighting housing is shown in U.S. Pat. No. 5,624,178. This system includes a telescoping frame for accommodation with a multitude of different types of lamp holders. The system, however, is not collapsible and involves a complex telescoping interconnection between the housing frame elements.

None of the prior art provides for a combination of elements forming a strip lighting housing and fixture assembly including first and second housing sections which are releasably engageable in order to form a main lighting housing assembly. The prior art Patents provide for lighting housing systems which are excessively bulky and involve complex interconnections of elements not lending themselves to ease of manufacture, shipping, assembly, and selective disassembly.

SUMMARY OF THE INVENTION

The present invention provides for a strip lighting housing and fixture assembly for the mounting of strip lighting elements and the associated electronics, with the strip lighting housing being affixed to a base surface. The strip lighting housing and fixture assembly includes first and second housing sections which releasably engage one another to form a main strip lighting housing assembly. The first and second housing sections are releasably locked to one another by a connecting member which releasably engages both the first and second housing sections. Further, first and second bracket members releasably engage respective ones of the first and second housing sections in order to releasably mount first and second cover members to the respective first and second housing sections. Thus, the first and second housing sections, the connecting member, the first and second bracket members, and the first and second cover members releasably engage one another to form a strip lighting housing and fixture assembly which may be easily manufactured, shipped, assembled, and selectively disassembled.

It is a principle objective of the subject strip lighting housing and fixture assembly to provide first and second housing sections which are releasably coupled to one another.

It is a further objective of the subject strip lighting housing and fixture assembly to provide a connecting member which releasably engages both the first and second housing sections to releasably lock the housing sections to one another.

It is a further objective of the subject strip lighting housing and fixture assembly to provide first and second bracket members, each releasably engaging a respective one of the first and second housing sections.

It is a further objective of the subject invention to provide first and second cover members with each cover member releasably engaging both the connecting member and a respective bracket member.

It is an important objective of the present invention to provide a strip lighting housing and fixture assembly which is collapsible, portable, and may be easily assembled and selectively disassembled.

DESCRIPTION OF THE PREFERRED EMBODIMENTS

Figure 1:
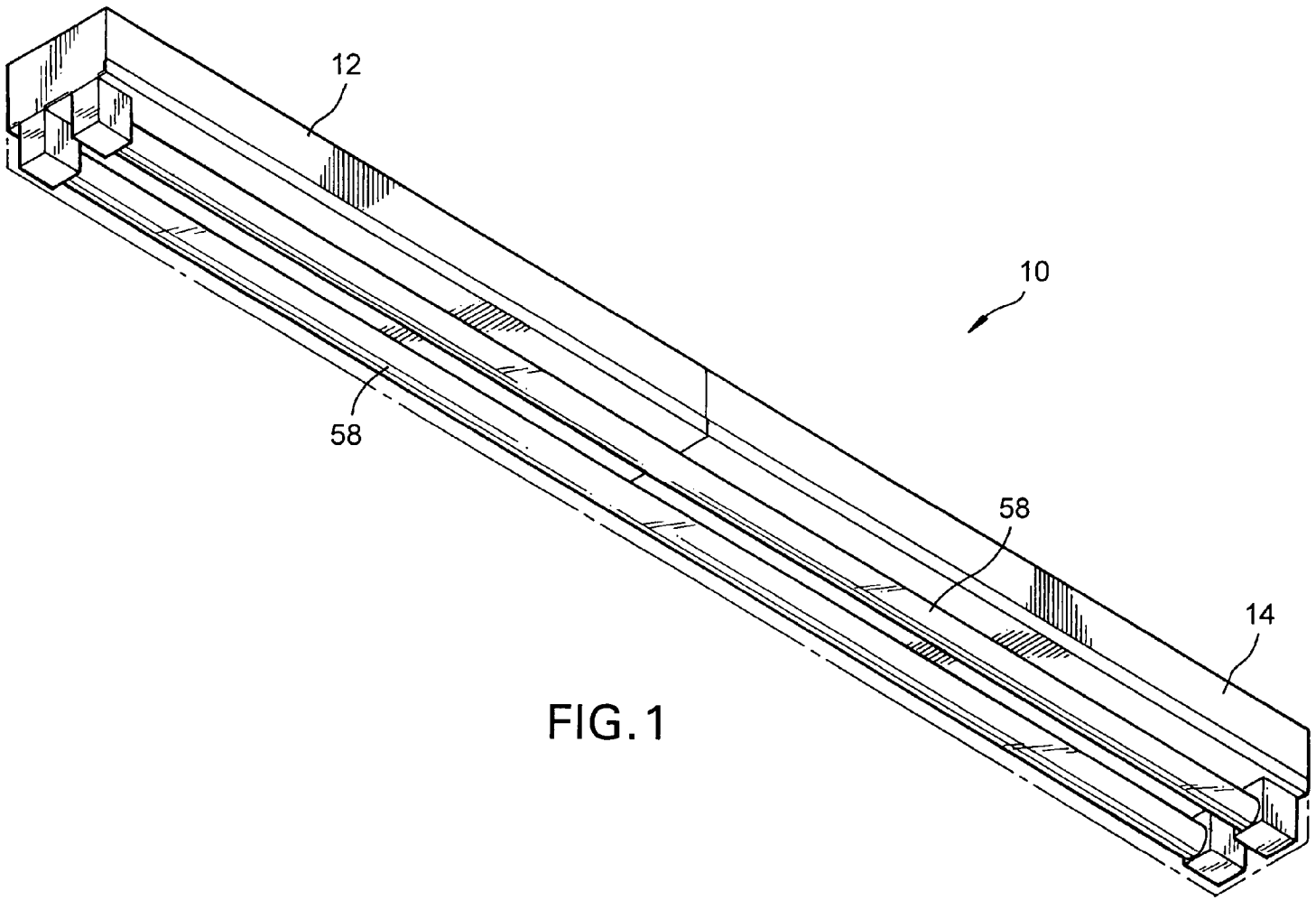
FIG. 1 is a perspective view of the subject lighting housing with a lighting fixture being mounted thereto.

Referring now to FIGS. 1–10, there is shown a strip lighting housing and fixture assembly 10 for the mounting and retention of strip lighting elements to a surface, such as a wall or ceiling. As shown in FIG. 1, the lighting system 10 includes a pair of standard fluorescent bulbs 58. Although FIG. 1 illustrates the use of fluorescent bulbs 58, any other suitable lighting fixtures, elements and devices may be used in combination with the strip lighting housing 10.

Typical strip lighting housings and fixtures, which are well-known in the art, are typically approximately 8 feet in length. These long fixtures and housings are both difficult to manufacture and also present problems in shipping due to their unwieldy sizes and lengths, in particular. The present system 10, however, is formed from a pair of housing sections 12, 14, which may be manufactured and shipped separately from one another, with each of the first and second housing sections 12, 14 being approximately 4 feet in length and being releasably engaged with one another to form the entire lighting housing 10.

Figure 2:
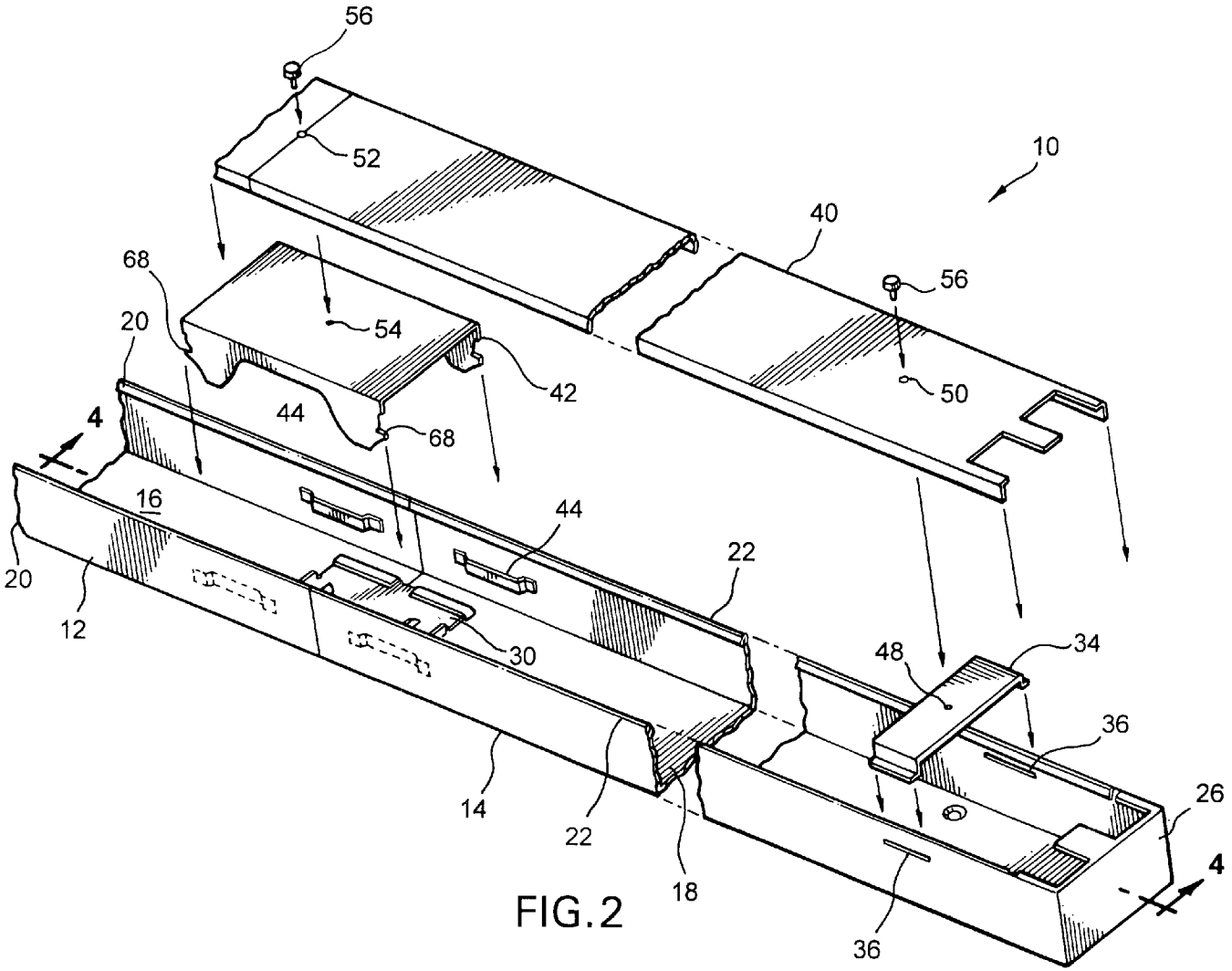
FIG. 2 is an exploded view of the strip lighting housing and fixture assembly.
Figure 7:
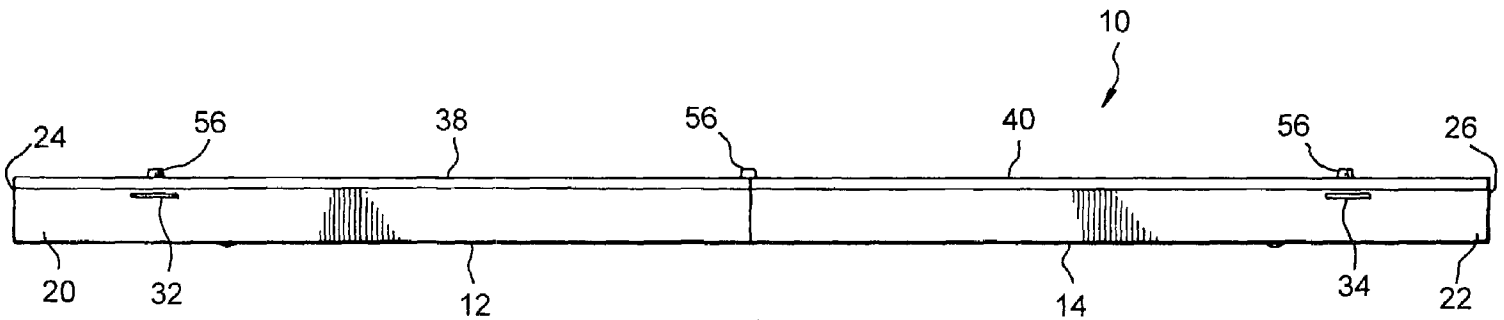
FIG. 7 is a longitudinal side view of the strip lighting housing and fixture assembly.

As shown in FIG. 2 of the Drawings, the first housing section 12 includes a first base 16 and a first pair of side walls 20. Similarly, the second housing section 14 includes a second base 18 and a second pair of side walls 22. The pairs of side walls 20, 22 extend longitudinally along the length of their respective bases 16, 18 and project substantially orthogonally thereto. Further, as shown in FIGS. 2 and 7, each of the housing sections 12, 14 further includes an end wall 24, 26. The end walls 24, 26 are positioned along closed ends of their respective housing sections 12, 14 and connect the respective pair of side walls 20, 22 in order to form a channel within the respective housing section 12, 14. Each housing section 12, 14 and the respective bases and walls 16, 18, 20, 22, 24, 26 may be formed from aluminum or any other suitable material for forming a lighting housing.

The housing sections 12, 14 may be formed with the same dimensions and may be substantially identical to one another. This allows for ease in the manufacturing process, as only one press or other manufacturing system and process is required for the creation of both first and second housing sections 12, 14.

Figure 3:
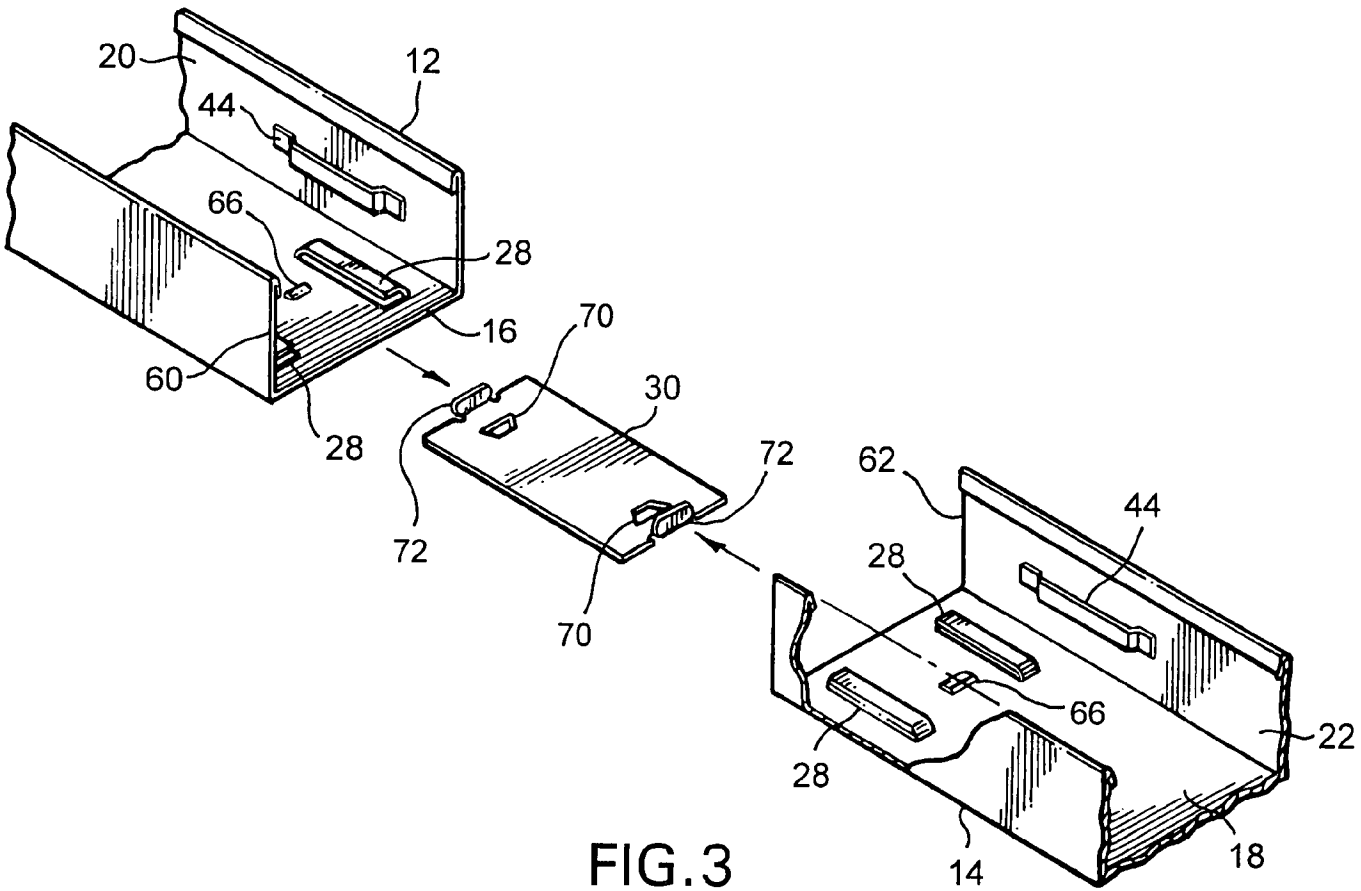
FIG. 3 is an exploded view of the locking plate assembly for the first and second housing sections of the strip lighting housing and fixture assembly.

As shown in FIG. 3, the first housing section 12 includes a first open end 60 positioned opposite the first end wall 24 and, similarly, the second housing section 14 includes a second open end 62 positioned opposite from the second end wall 26. As shown in FIG. 2, when fully assembled, the two open ends 60, 62 are joined to form the fully assembled lighting housing 10.

The first and second housing sections 12, 14 releasably engage one another, as shown in FIGS. 2 and 3. As shown in FIG. 3 particularly, the housing 10 further includes a locking plate 30. Retaining members 28 are formed on first and second bases 16, 18 near the respective open ends 60, 62 of sections 12, 14. Locking plate 30 releasably engages both sets of retaining members 28 in order to releasably hold the first housing section 12 to the second housing section 14.

As shown in FIGS. 2 and 7, each of the four side walls 20, 22 has a slot 36 formed therethrough, with the slot 36 being positioned near the respective end wall 24, 26. First bracket 32 releasably engages the pair of slots 36 formed in first housing section 12 and, likewise, second bracket 34 releasably engages the pair of slots 36 formed in the second housing section 14. Each bracket 32, 34 has an opening 48 formed therethrough, as shown in FIG. 2.

Figure 4:
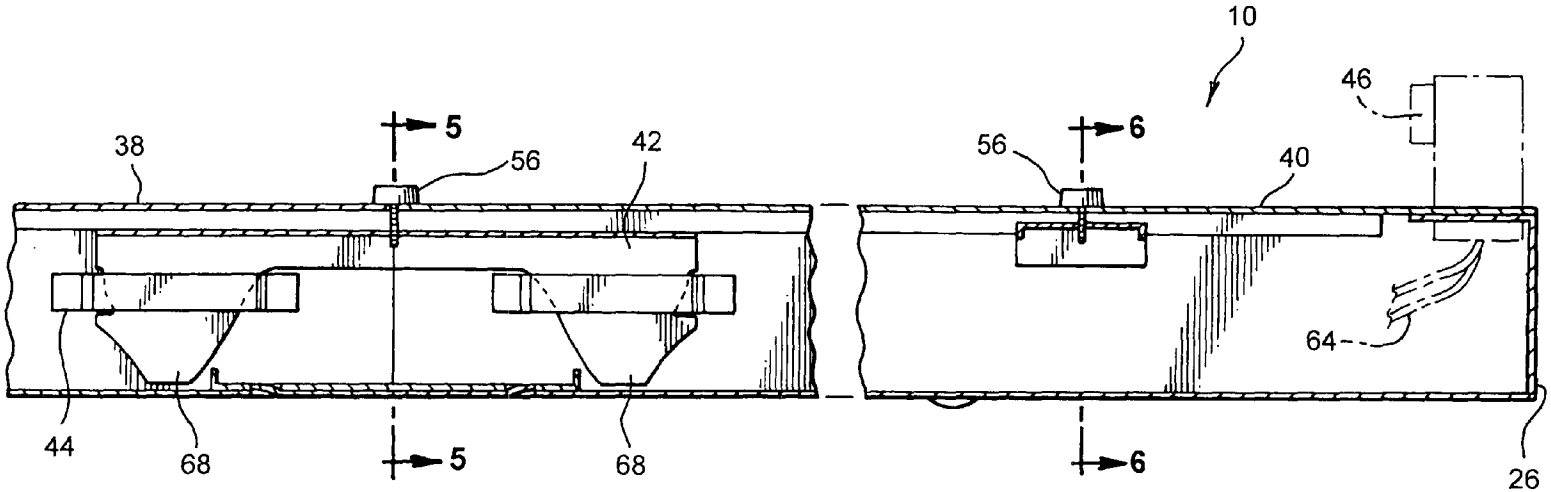
FIG. 4 is a cut-away side view of the subject strip lighting housing and fixture assembly taken along cross-sectional line 4—4.

As shown in FIGS. 2 and 4 of the Drawings, each of the side walls 20, 22 has a retaining bracket 44 mounted thereon, with each retaining bracket 44 being positioned near the respective open end 60, 62 of first and second housing sections 12, 14. A connecting member 42 releasably engages retaining brackets 44, as shown in FIG. 4, in order to releasably lock first housing section 12 to second housing section 14. As shown in FIG. 2, the connecting member 42 has an opening 54 formed therethrough.

As further shown in FIG. 2, the connecting member 42 has a plurality of hook members 68 projecting therefrom. As shown in FIG. 4 of the Drawings, hooks 68 releasably engage retaining brackets 44 in order to selectively secure first housing section 12 to second housing section 14.

First and second housing sections 12, 14 are further releasably secured to one another by locking plate 30. As shown in FIG. 3 of the Drawings, the locking plate 30 has a pair of engaging openings 70 formed therethrough. Additionally, each base 16, 18 has a locking finger member 66 projecting therefrom and positioned near each respective open end. The locking plate 30 slidingly engages the retaining members 28 and the locking finger members 66 releasably engage the engaging openings 70 in order to releasably secure first and second housing sections 12 and 14 to one another. Additionally, the locking plate 30 has a pair of finger grips 72 projecting therefrom, enabling a user to more easily grasp locking plate 30 and selectively separate first and second housing sections 12, 14 from one another.

The strip lighting housing and fixture assembly 10 is formed from first and second housing sections 12, 14, which are releasably coupled to one another, and by locking plate 30, connecting member 42, brackets 34, and cover members 38, 40. Each of these elements is releasably coupled to one another, and may be manufactured and shipped separately from each other. The releasable locking and coupling of elements in order to form the entire strip lighting housing and fixture assembly 10 allows for ease in manufacturing, shipping, assembly, and selective disassembly of the collapsible housing 10.

As shown in FIGS. 2 and 7, the strip lighting housing and fixture 10 includes first and second cover members 38 and 40. First cover member 38 is releasably mounted on first bracket 32 and connecting member 42, and likewise, the second cover member 40 is releasably mounted on second bracket 34 and connecting member 42. Each cover member 38, 40 has a first cover opening 50 formed therethrough, with the opening 50 being positioned in alignment with the bracket opening 48. Securement means 56 are provided for releasably joining the cover members 38, 40 to respective brackets 32, 34. The securement means 56 may be threaded screws, bolts, or the like.

Figure 10:
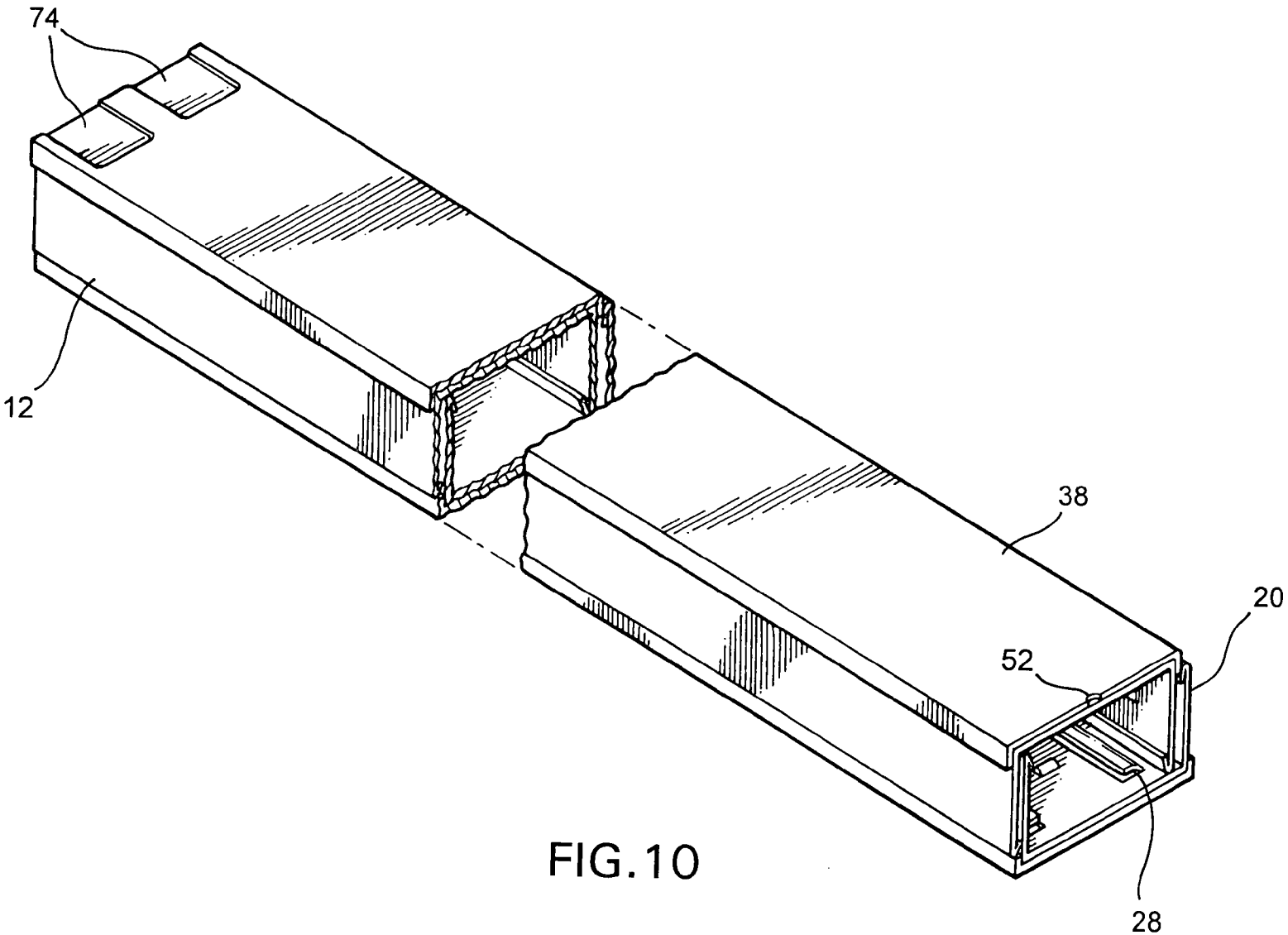

Additionally, as shown in FIGS. 2 and 10, each cover member 38, 40 has a semi-circular opening 52 formed along the end of the cover member which is positioned adjacent to the respective open end 60, 62 of first and second housing sections 12, 14. As shown in FIG. 2, the two semi-circular openings 52 form a joint circular opening which is positioned in alignment with opening 54 of the connecting member 42. Securement means 56, in the form of a screw, bolt, or the like, releasably secures both cover members 38, 40 to the connecting member 42.

FIG. 4 illustrates the assembled strip lighting housing and fixture 10 with first cover member 38 secured to the first housing section 12 and second cover member 40 being secured to the second housing section 14 by the securement means 56. Additionally, FIG. 4 illustrates lighting socket 46 being mounted to the second housing section 14 with wires or cables 64 leading to the interior of the lighting housing 10 for connection to standard lighting control electronics.

Figure 5:
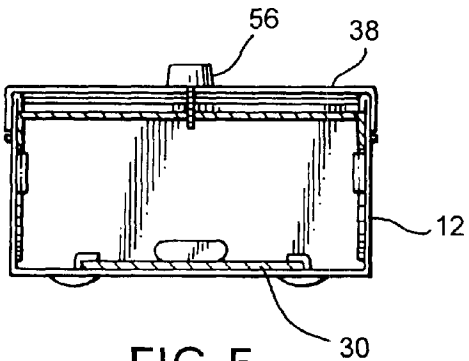
FIG. 5 is a cross-sectional view of the strip lighting housing and fixture assembly taken along cross-sectional line 5—5.

FIG. 5 is a cross-sectional view of lighting housing 10 taken along cross-sectional line 5—5. As shown in FIG. 5, the first cover member 38 is dimensioned and shaped in order to provide a snug and secure fit with first housing section 12. Although first housing section 12 and first cover member 38 are shown in the Drawing as having a substantially rectangular cross-sectional shape, this is merely for illustrative purposes and the lighting housing 10 may take any size or shape depending upon the needs of the user.

Figure 6:
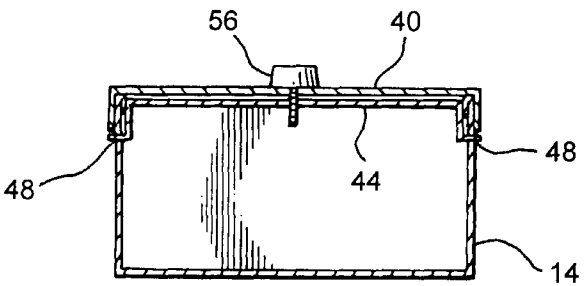
FIG. 6 is a cross-sectional view of the strip lighting housing and fixture assembly taken along cross-sectional line 6—6.

FIG. 6 is a cross-sectional view of lighting housing 10 taken along the cross-sectional line 6—6. As shown in FIG. 6, the retaining bracket 44 engages the pair of bracket openings 48 with the respective ends of bracket 44 projecting through openings 48 allowing for ease in disengagement or disassembly of the brackets 44 from the housing 10. Additionally, brackets 44 are dimensioned and shaped in order to fit securely against the cover members 40 (and cover member 38 as shown in FIG. 5). The brackets 48 are secured to cover members 40 (and cover member 38 as shown in FIG. 5) via securement means 56, illustrated as a threaded screw in FIG. 6, although any securement means may be utilized.

Figure 8:
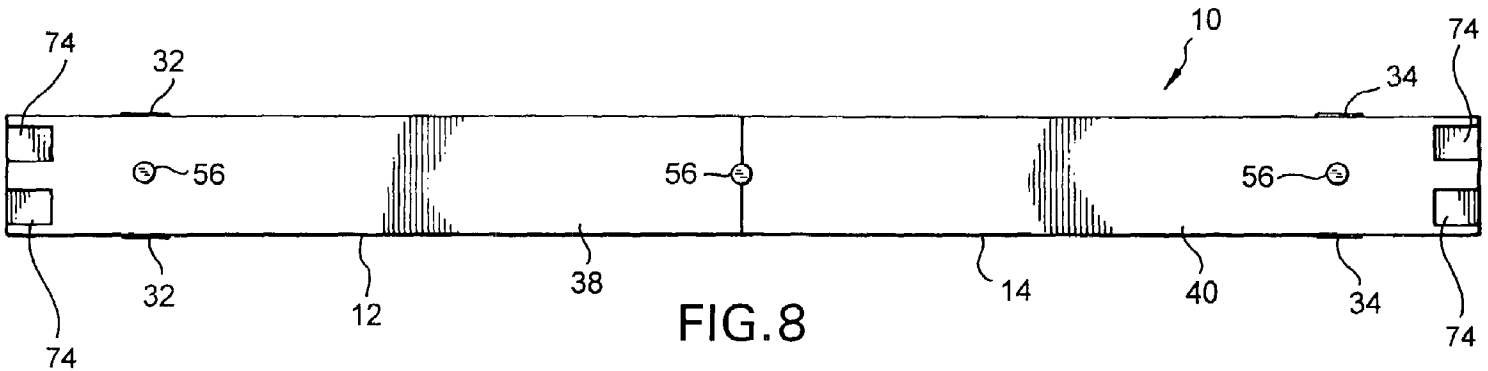
FIG. 8 is a top view of the strip lighting housing and fixture assembly.

As shown in FIG. 8, each cover member 38, 40 is provided with a pair of openings 74 formed therethrough, the openings being positioned adjacent the respective end walls 24, 26 of the housing sections 12, 14. The socket openings 74 are provided to receive lighting sockets 46, as shown in FIG. 4. Although shown in FIG. 8 as being substantially rectangular in shape, the sockets 74 may be both shaped and dimensioned depending upon the needs of the user.

Figure 9:
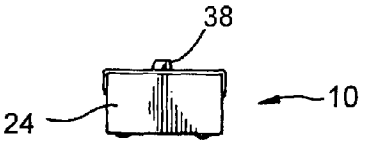
FIG. 9 is a lateral side view of the strip lighting housing and fixture assembly; and, FIG. 10 is a partial perspective view of the strip lighting housing and fixture assembly.

FIG. 9 is a side view of lighting housing 10. Although end wall 24 is shown as being substantially rectangular in shape, it should be realized that the lighting housing 10 may take any size and shape, depending upon the particular needs of the user, and depending upon the dimensions and particular properties of the lighting equipment to be affixed to housing 10.

The strip lighting housing and fixture assembly 10 is collapsible and is formed from a plurality of individual elements which are releasably locked and coupled to one another. Each of these elements may be assembled and shipped separately from one another. The releasable coupling of elements to form the entire housing and fixture assembly 10 provides for a strip lighting housing and fixture assembly 10 which is collapsible and portable, as well as providing for ease in manufacture, assembly, and selective disassembly of the entire system.

Although this invention has been described in connection with specific forms and embodiments thereof, it will be appreciated that various modifications other than those discussed above may be resorted to without departing from the spirit or scope of the invention. For example, functionally equivalent elements may be substituted for those specifically shown and described, and proportional quantities of the elements shown and described may be varied, all without departing from the spirit or scope of the invention as defined in the appended Claims.

What is claimed is:

1. A strip lighting housing and fixture assembly comprising:

first and second housing sections, each said housing section having a base and a pair of opposed side walls, each said pair of side walls extending longitudinally along a respective one of said bases and projecting substantially orthogonally therefrom, each said housing section further having an end wall mounted on a closed end thereof, each said end wall connecting a respective one of said pairs of side walls and extending substantially orthogonally from a respective one of said bases, each said housing section having an open end formed opposite said closed end, said open end of said first housing section releasably engaging said open end of said second housing, and said first and second housing section including a pair of retaining brackets thereon, each said pair of retaining brackets being positioned adjacent to a respective one of said open ends;

a connecting member releasably engaging said first and second housing sections to releasably lock said housing sections together, said connecting member releasably engaging said retaining brackets;

first and second bracket members each releasably engaging respective ones of said first and second housing sections, each said bracket member connecting a respective one of said pairs of side walls and being positioned substantially parallel to a respective one of said bases; and, first and second cover members, each said cover members releasably engaging said connecting member and a respective one of said bracket members to form a covered strip lighting enclosure which is collapsible and may be selectively disassembled.

2. The strip lighting housing and fixture assembly as recited in claim 1 wherein each said base further includes a pair of retaining members formed thereon, each said pair of retaining members being positioned adjacent a respective one of said open ends.

3. The strip lighting housing and fixture assembly as recited in claim 2 further comprising a locking plate which releasably engages said pairs of retaining members in order to releasably secure said first housing section to said second housing section.

4. The strip lighting housing and fixture assembly as recited in claim 3 wherein said locking plate includes a pair of openings formed therethrough, each said opening engaging a respective locking finger member formed on a respective base of said first and second housing sections, said locking plate releasably engaging said pair of locking finger members.

5. The strip lighting housing and fixture assembly as recited in claim 1 wherein said connecting member includes a plurality of hooks formed thereon, said plurality of hooks releasably engaging said retaining brackets.

6. The strip lighting housing and fixture assembly as recited in claim 1 further comprising securement means for releasably engaging said first and second cover members respectively to said first and second housing sections.

7. The strip lighting housing and fixture assembly as recited in claim 6 wherein each of said first and second cover members has a semi-circular opening formed therethrough, said semi-circular opening being formed on an end corresponding to a respective one of said open ends of said first and second housing sections, said semi-circular openings forming a circular opening for engagement with said securement means when said first and second cover members are positioned adjacent and contiguous to one another.

8. The strip lighting housing and fixture assembly as recited in claim 1 wherein each of said first and second cover members is adapted to receive a lighting socket.

9. A strip lighting housing and fixture assembly comprising:

first and second housing sections, each said housing section having a base and a pair of opposed side walls, each said pair of side walls extending longitudinally along a respective one of said bases and projecting substantially orthogonally therefrom, each said housing section further having an end wall mounted on a closed end thereof, each said end wall connecting a respective one of said pairs of side walls and extending substantially orthogonally from a respective one of said bases, each said housing section having an open end formed opposite said closed end, said open end of said first housing section releasably engaging said open end of second said housing, each said base having a pair of retaining members formed thereon, each said pair of retaining members being positioned adjacent a respective one of said open ends, and said first and second housing section including a pair of retaining brackets mounted thereon, each said pair of retaining brackets being positioned adjacent to a respective one of said open ends;

a locking plate releasably engaging said pairs of retaining members in order to releasably secure said first housing section to said second housing section;

a connecting member releasably engaging said first and second housing sections to releasably lock said housing sections together, said connecting member releasably engaging said retaining brackets;

the first and second bracket members each releasably engaging respective ones of said first and second housing sections, each said bracket member connecting a respective one of said pairs of side walls and being positioned substantially parallel to a respective one of said bases; and, first and second cover members, each said cover member releasably engaging said connecting member and a respective one of said bracket members to form a covered strip lighting enclosure which is collapsible and may be selectively disassembled.

10. The strip lighting housing and fixture assembly as recited in claim 9, wherein said locking plate includes a pair of engaging openings formed therethrough.

11. The strip lighting housing and fixture assembly as recited in claim 10 wherein each said base includes an engaging finger projecting therefrom, ach said engaging finger releasably engaging a respective one of said engaging openings of said locking plate to releasably lock said locking plate to said first and second housing sections.

12. The strip lighting housing and fixture assembly as recited in claim 9 wherein said connecting member include a plurality of hooks formed thereon, said hooks releasably engaging said retaining brackets.

13. The strip lighting housing and fixture assembly as recited in claim 9 further comprising securement means for releasably engaging said first and second cover members respectively to said first and second housing sections.

14. The strip lighting housing and fixture assembly as recited in claim 13 wherein each of said first and second cover members includes a semi-circular opening formed therethrough, said semi-circular opening being formed on an end corresponding to a respective one of said open ends of aid first and second housing sections, said semi-circular openings forming a circular opening for engagement with said securement means when said first and second cover members are positioned adjacent and contiguous to one another.

15. The strip lighting housing and fixture assembly as recited in claim 9 wherein each of said first and second cover members is adapted to receive a lighting socket.

16. The strip lighting housing and fixture assembly as recited in claim 9 wherein said first and second housing sections are formed of a metal composition.

* * * * *